US008783659B2

(12) United States Patent
Blosser

(10) Patent No.: US 8,783,659 B2
(45) Date of Patent: Jul. 22, 2014

(54) STRING LOOP TENSIONING PLIERS DEVICE AND METHOD OF USE

(76) Inventor: Ben D. Blosser, Richland, IN (US)

( * ) Notice: Subject to any disclaimer, the term of this patent is extended or adjusted under 35 U.S.C. 154(b) by 249 days.

(21) Appl. No.: 13/244,980

(22) Filed: Sep. 26, 2011

(65) Prior Publication Data

US 2012/0085982 A1 Apr. 12, 2012

Related U.S. Application Data

(60) Provisional application No. 61/390,674, filed on Oct. 7, 2010.

(51) Int. Cl.
*B66F 3/00* (2006.01)
*F41B 5/14* (2006.01)

(52) U.S. Cl.
CPC ..... *F41B 5/148* (2013.01); *F41B 5/1411* (2013.01)
USPC ..... 254/248; 254/302; 254/304

(58) Field of Classification Search
USPC ..... 81/418–426.5, 90.5, 90.7, 90.8, 302, 81/304; 254/248, 243
See application file for complete search history.

(56) References Cited

U.S. PATENT DOCUMENTS 131,188 A * 9/1872 Sneider ..... 86/40
1,095,054 A * 4/1914 Wissenfield ..... 294/118
1,929,163 A * 10/1933 Diskin et al. ..... 254/248
2,327,368 A * 8/1943 Olson ..... 81/374
2,737,917 A * 3/1956 Steele ..... 81/303
3,022,510 A * 2/1962 O'Malley ..... 227/78
3,149,015 A * 9/1964 Lindsay ..... 156/502
3,217,519 A * 11/1965 Demler ..... 72/19.7
3,233,313 A * 2/1966 Roth ..... 29/235
3,263,535 A * 8/1966 Zurcher ..... 81/302
3,540,106 A * 11/1970 Goldman ..... 29/268
3,599,935 A * 8/1971 Walker ..... 254/131
3,647,186 A * 3/1972 Hartman ..... 254/248
3,656,679 A * 4/1972 Minasy ..... 227/144
4,086,904 A * 5/1978 Suski et al. ..... 124/90
4,179,782 A * 12/1979 Forman et al. ..... 29/268
4,181,046 A * 1/1980 Lamb ..... 81/487
4,235,073 A * 11/1980 Tracy ..... 59/11
4,317,986 A * 3/1982 Sullivan ..... 219/231
4,365,411 A * 12/1982 Muldoon, Jr. ..... 29/845
4,386,461 A * 6/1983 Plummer ..... 29/749
4,769,891 A * 9/1988 Corral ..... 29/268
5,020,508 A * 6/1991 Greene, Jr. ..... 124/35.2
5,165,155 A * 11/1992 Adams ..... 29/268
5,220,906 A * 6/1993 Choma ..... 124/25
5,249,720 A * 10/1993 White ..... 223/112

(Continued)

*Primary Examiner* — Emmanuel M Marcelo
*Assistant Examiner* — Michael Gallion
(74) *Attorney, Agent, or Firm* — Lyman Moulton, Esq.

(57) ABSTRACT

A string loop tensioning pliers device includes a first member comprising a first handle and a fixed arcuate jaw comprising an upper jaw and a lower jaw. The lower jaw has an arcuate claw end and the upper jaw has a first lateral dowel pin end and three in-line lateral facing beveled prongs. A second member comprises a second handle pivotally connected above the first member and includes a notched end opposite the handle and a second lateral dowel pin configured to join with the middle prong when the pliers are closed. A method for using the disclosed tensioning pliers includes tensioning a string knotted to the bowstring, spreading a loop created on the bowstring and tensioning the created loop by inserting the middle prong joined with the second lateral dowel through the formed loop and squeezing the pliers to separate the middle prong and the second lateral dowel.

11 Claims, 15 Drawing Sheets

(56) References Cited

U.S. PATENT DOCUMENTS

| | | | | | |
|---|---|---|---|---|---|
| 5,277,089 | A * | 1/1994 | McGushion | 81/487 |
| 5,327,802 | A * | 7/1994 | Yu | 81/312 |
| 5,367,755 | A * | 11/1994 | Wood | 29/227 |
| 5,474,637 | A * | 12/1995 | Soodak | 156/272.6 |
| 5,724,870 | A * | 3/1998 | Wiebe et al. | 81/9.43 |
| 5,822,865 | A * | 10/1998 | Bosch et al. | 30/134 |
| D408,239 | S * | 4/1999 | Steiner et al. | D8/54 |
| 5,937,842 | A * | 8/1999 | Summers et al. | 124/35.2 |
| 6,272,738 | B1 * | 8/2001 | Holliday et al. | 29/751 |
| 6,412,375 | B1 * | 7/2002 | Wang et al. | 81/418 |
| 6,792,837 | B2 * | 9/2004 | Battistone | 81/302 |
| 7,055,413 | B1 * | 6/2006 | Wang | 81/302 |
| D557,579 | S * | 12/2007 | Steiner | D8/52 |
| 7,398,956 | B2 * | 7/2008 | Clark et al. | 254/248 |
| 7,536,896 | B1 * | 5/2009 | Hung | 72/409.16 |
| 7,571,505 | B2 * | 8/2009 | Hiller | 7/164 |
| D605,917 | S * | 12/2009 | Sands | D8/52 |
| 7,641,176 | B2 * | 1/2010 | Clark et al. | 254/248 |
| 8,087,137 | B2 * | 1/2012 | Wang | 29/266 |
| 2003/0041702 | A1 * | 3/2003 | Kang | 81/302 |
| 2007/0187660 | A1 * | 8/2007 | Clark et al. | 254/243 |
| 2008/0277635 | A1 * | 11/2008 | Clark et al. | 254/248 |
| 2009/0301272 | A1 * | 12/2009 | Chen | 81/304 |
| 2010/0108964 | A1 * | 5/2010 | Clark et al. | 254/248 |

* cited by examiner

STRING LOOP TENSIONING PLIERS DEVICE AND METHOD OF USE

CROSS-REFERENCE TO RELATED APPLICATION

This application claims the benefit of the priority date of earlier filed U.S. Provisional Patent Application Ser. No. 61/390,674, filed Oct. 7, 2010 for Ben D. Blosser, incorporated herein by reference in its entirety.

BACKGROUND OF THE INVENTION

String loops provide several benefits to the archery sportsman and the professional alike and are a popular addition to archery bow strings. String loops are also known as rope loops, bow loops and/or D-loops. Some of the many benefits include the prevention of premature wear on the serving because the release is no longer attached directly to the bowstring and therefore the amount of time between changing a string is greatly increased. Also, the elimination of "nock pinch" when at full draw, prevents the arrow from failing off the bow string and also coming off the string when let down. Perhaps the most important benefit of a string loop is that it may also enhance shooting accuracy.

While string loops may be easily attached to the bow string via a pair of simple cinch knots, forming the rope loop on the bow string with the proper amount of tension in the loop may be problematic. However, care must be taken to install the string loop without damaging the bow string serving or the loop itself. Tapered needle nose pliers, screw drivers and T-handle Allen wrenches have been used to apply direct manual pressure on the rope to tighten the cinch knots. However, such impromptu procedures have the risk of damaging the bow string by separating the outer and inner string fibers. Also, the results from various impromptu procedures are not the most effective nor the best application of the user's time and effort.

SUMMARY OF THE INVENTION

A disclosed string loop tensioning pliers device includes a first member having a first handle section and a fixed arcuate jaw comprising an upper jaw and a lower jaw. The lower jaw has an arcuate claw end and the upper jaw has a first lateral dowel pin end, three in-line and lateral facing beveled prongs and a pivot boss extending from the upper jaw. A middle prong of the three is configured to join with a second lateral dowel pin of a second member. The second member is pivotally connected to the first member and comprises a second handle section, a notched end opposite the handle section and a pivot boss there between and a second lateral dowel pin configured to join with the middle prong when the first handle and the second handle are distally positioned.

A method of using the string loop tensioning pliers device includes tensioning a string knotted to the bowstring on one end by positioning the string through the arcuate claw end of the first member over a first knot on the bowstring and inserting a sacrificial knot into the notched end of the second member and squeezing the first handle toward the second handle. The method also includes spreading a loop created on the bowstring by removing the sacrificial knot and forming a second knot on the bow string in its place and positioning the claw to straddle the bowstring. The first lateral dowel pin is inserted through the formed string loop and the pliers device is rocked back against the arcuate claw and the bowstring to pre-tension the loop. The method further includes further tensioning the formed string loop by inserting the middle prong joined with the second lateral dowel through the created or formed loop and positioning the bowstring underneath the three prongs and squeezing the first handle against the second handle.

Other aspects and advantages of embodiments of the disclosure will become apparent from the following detailed description, taken in conjunction with the accompanying drawings, illustrated by way of example of the principles of the disclosure.

BRIEF DESCRIPTION OF THE DRAWINGS

Throughout the description, similar reference numbers may be used to identify same and similar elements in the multiple drawings and figures above.

DETAILED DESCRIPTION

Figure 1:
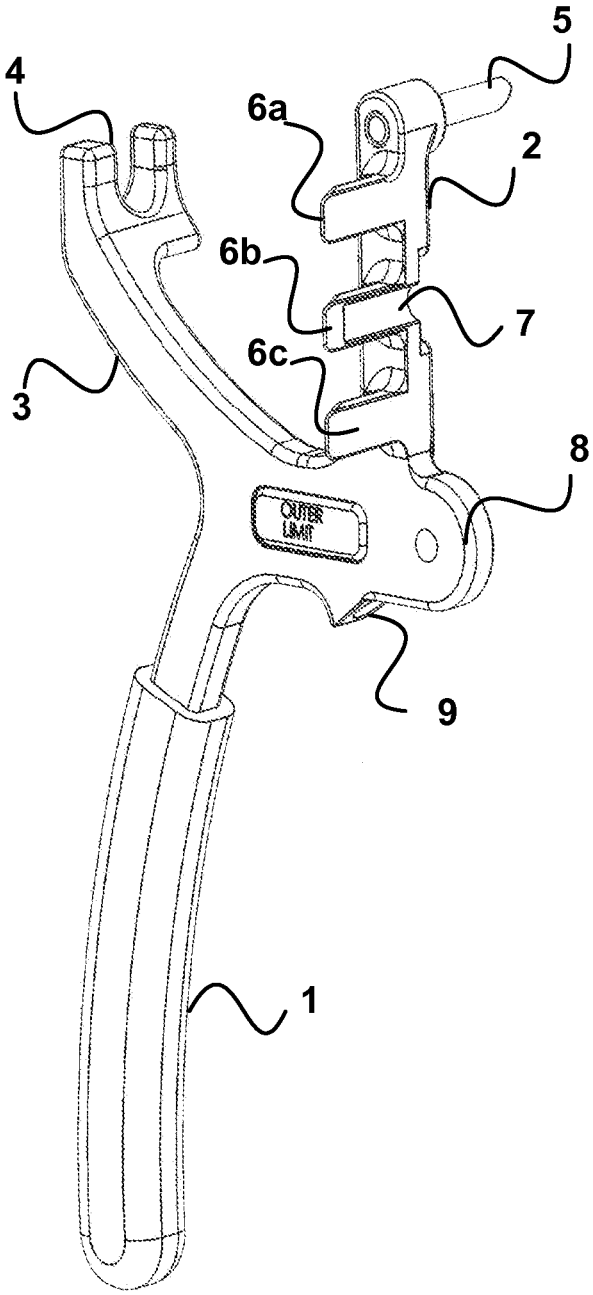
FIG. 1 depicts a left side perspective view of a first member of the string loop tensioning pliers device in accordance with an embodiment of the present disclosure.

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

The disclosed string loop tensioning pliers device allows for installation of a very small string loop to increase the power stroke of the bow and arrow velocity. In other words, as the length of the loop is shortened, the bows' effective draw length at rest is also shortened. Therefore the bows' active draw length to store potential energy may be further lengthened by the user thus increasing the bows power stroke and arrow velocity upon release. Loose string loops in the prior art may not be able to achieve the same bow active draw length and associated power stroke and arrow velocity.

FIG. 1 depicts a left side perspective view of a first member of the string loop tensioning pliers device in accordance with an embodiment of the present disclosure. The function of the disclosed pliers device is one of spreading rather than crimping. The first member includes a first handle section 1, a fixed arcuate jaw comprising an upper jaw 2 and a lower jaw 3. The lower jaw 3 has an arcuate claw end 4 and the upper jaw 2 has a first lateral dowel pin end 5 and three in-line and lateral facing beveled prongs 6*a*, 6*b* and 6*c*. A middle prong 6*b* of the three has a rounded groove 7 therein. The first member also includes a pivot boss 8 and a first spring bore 9. The first lateral dowel pin 5 has a diameter and length designed to be inserted through a small loop of string. The in-line prongs 6*a, b* and *c* are designed to accommodate two knots of the loop of string tied to a bowstring. The arcuate claw end 4 of the first member 1 is configured to gently straddle a bowstring in one configuration and to straddle a knot of string tied to the bowstring in another configuration. A pivot pin (not shown) is disposed axially to the pivot boss of both the first member and the second member, the second member thus configured to pivot above the upper jaw and the first handle section of the first member.

The three in-line and lateral facing beveled prongs 6*a, b* and *c* are spaced apart approximately 8 to 10 mm to accommodate a string knot on either side of the middle prong. Each prong adjacent to the middle prong extends approximately 17 mm from the upper jaw 2 and each adjacent prong is approximately 6 mm wide by approximately 3 mm thick and a bottom side of each prong facing the lower jaw 3 is substantially flat. The middle prong rounded groove 7 is configured in a top surface of the middle prong in relation to the lower jaw 3, the rounded groove 7 measuring approximately less than 5 mm wide. All dimensions and measurements as specified herein may be adjusted plus or minus 10% for tolerance in manufacturing the pliers device as disclosed.

An inside distance between a first tip of the arcuate claw end 4 of the lower jaw 3 to a second tip of the claw end 4 measures approximately 8 to 10 mm plus or minus 10% to accommodate a knot tied in a string loop to a bow string. The bowstring is placed beneath the claw and the string loop string is brought up between the two tips of the claw end 4 toward the upper jaw 2 where it will make contact with the second member as further explained below.

Figure 2:
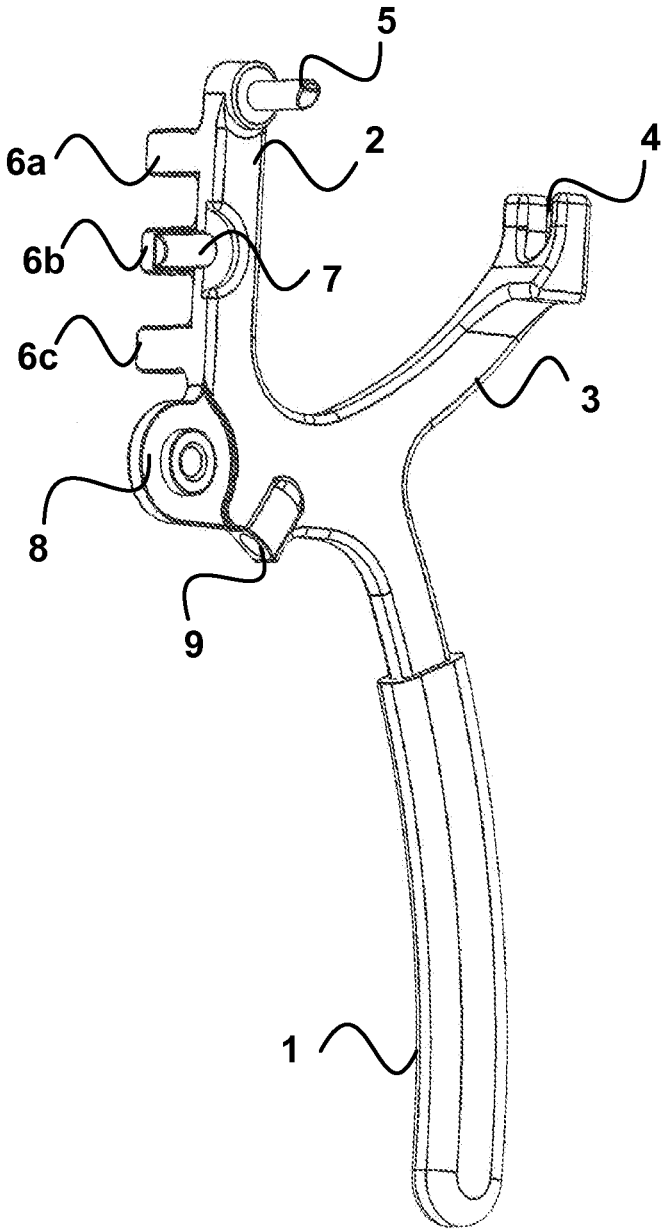
FIG. 2 depicts a right side perspective view of the first member of the string loop tensioning pliers device in accordance with an embodiment of the present disclosure.

FIG. 2 depicts a right side perspective view of the first member of the string loop tensioning pliers device in accordance with an embodiment of the present disclosure. The depiction shows the first handle section 1, the fixed arcuate jaw comprising the upper jaw 2 and the lower jaw 3. The lower jaw 3 comprises the arcuate claw end 4. The upper jaw 2 comprises the first lateral dowel pin 5 on an end opposite the handle 1 and the three in-line and lateral facing beveled prongs 6*a, b* and *c*. The middle prong 6*b* of the three prongs has a rounded groove 7 therein. The first member depicted also shows the pivot boss 8 and the first spring bore 9.

Figure 3:
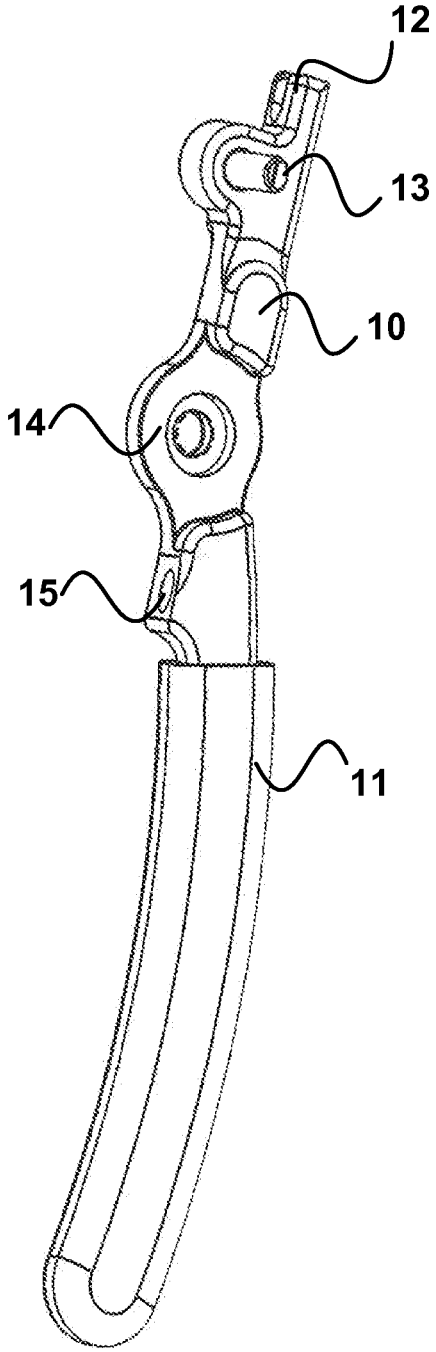
FIG. 3 depicts a left side perspective view of a second member of the string loop tensioning pliers device in accordance with an embodiment of the present disclosure.

FIG. 3 depicts a left side perspective view of a second member of the string loop tensioning pliers device in accordance with an embodiment of the present disclosure. The second member pivotally connected to the first member includes a stop boss 10, a second handle section 11, a knot recess or notched end 12 opposite the handle section 11 and a second lateral dowel pin 13 configured to be partially recessed into the middle prong rounded groove 7 (not depicted) when the first handle 1 and the second handle 11 are distally positioned. The second member additionally includes a pivot boss 14 and a second spring bore 15.

The stop boss 10 is formed on an inside of the second member. The stop boss 10 is configured to overlap the second member with the first member upper jaw 2 and therefore limit a distal extension of the first handle 1 to the second handle 11. An embodiment of the present disclosure includes a low durometer material covering or coating on the stop boss 10 at least where it contacts the first member and therefore providing a cushioned closing of the first member upper jaw 2 against the second member and the second lateral dowel 13 into the rounded groove 7 of the middle prong.

Figure 4:
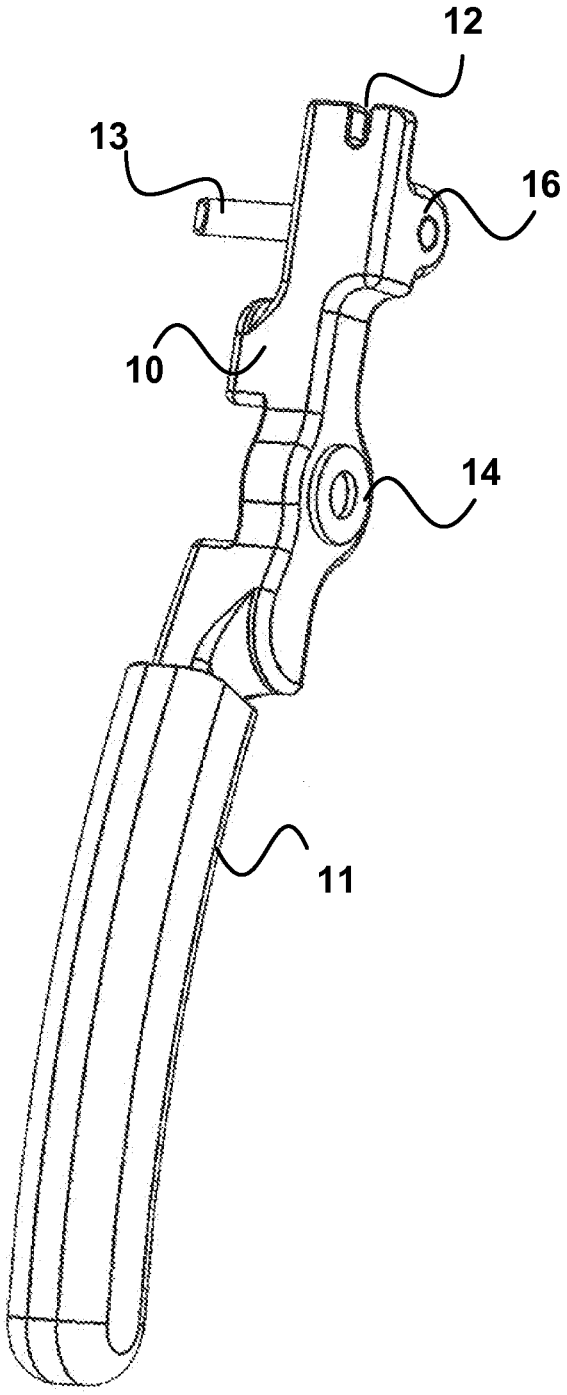
FIG. 4 depicts a top right perspective view of the second member of the string loop tensioning pliers device in accordance with an embodiment of the present disclosure.

FIG. 4 depicts a top right perspective view of the second member of the string loop tensioning pliers device in accordance with an embodiment of the present disclosure. The second member as depicted shows the stop boss 10, the second handle section 11, a knot recess or notched end 12 opposite the handle section 11 and a second lateral dowel pin 13 configured to be partially recessed into the middle prong rounded groove 7 (not depicted) when the first handle 1 and the second handle 11 are distally positioned. The depiction also shows the pivot boss 14 and a second lateral dowel pin boss 16. The notched end of the second member measures approximately 4 mm in length by 2 mm wide plus or minus 10% to accommodate a typical string loop thickness.

Figure 5:
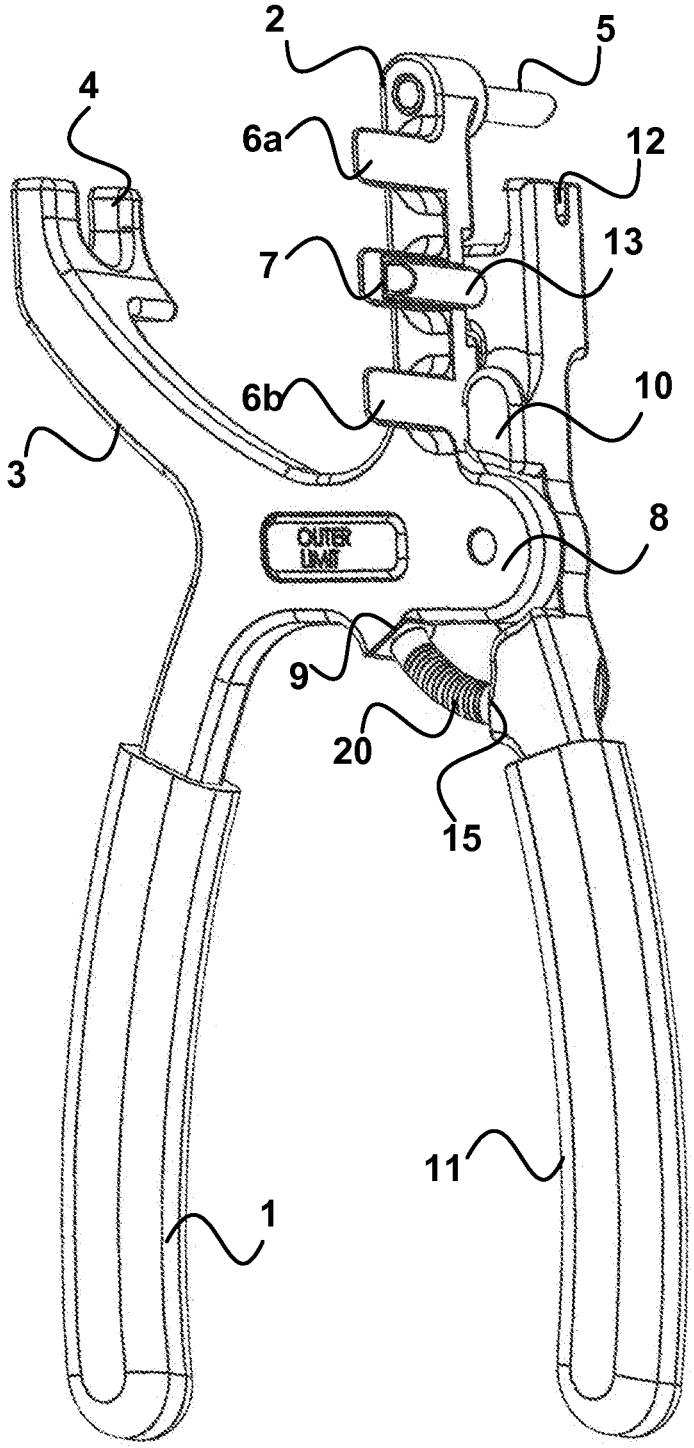
FIG. 5 depicts a closed left side perspective view of the first and second members of the string loop tensioning pliers device in accordance with an embodiment of the present disclosure.

FIG. 5 depicts a closed left side perspective view of the first and second members of the string loop tensioning pliers device in accordance with an embodiment of the present disclosure. The first member includes a first handle section 1, a fixed arcuate jaw comprising an upper jaw 2 and a lower jaw 3. The lower jaw has an arcuate claw end 4 and the upper jaw has a first lateral dowel pin end 5 and three in-line and lateral facing beveled prongs 6*a*, 6*b* and 6*c*. A middle prong 6*b* of the three has a rounded groove 7 in a top surface relative to the lower jaw thereof. The first member also includes a pivot boss 8 and a first spring bore 9. The second member pivotally connected to the first member includes a stop boss 10, a second handle section 11, a knot recess or notched end 12 opposite the handle section 11 and a second lateral dowel pin 13 configured to be partially recessed into the middle prong rounded groove 7 when the first handle 1 and the second handle 11 are distally positioned. The second member additionally includes the second spring bore 15. Received into the first spring bore 9 and into the second spring bore 15 is the spring 20. The spring 20 opposes a user squeezing the first handle 1 toward the second handle 11 to separate the first lateral dowel pin 5 from the middle prong rounded groove 7. The spring also positions the first handle distally from the second handle when the pliers device is not in use. An inside distance from a tip of the claw end 4 to a tip of the notched end 12 measures nominally 70 mm when the first and the second handles are distally positioned to enable a user to grasp the pliers device.

In an embodiment of the present disclosure, the first dowel pin 5 extends in an opposite lateral direction to the three in-line and lateral facing beveled prongs 6*a, b* and *c* and the second dowel pin 13 extends in the same lateral direction as the three beveled prongs, the first and second dowel pins are both secured at one end to a respective member and an unsecured respective end is beveled to facilitate the penetration of the respective dowel pin into a small loop of string. The first and second dowel pins measure approximately 3 mm in diameter and the first dowel pin 5 extends approximately 18 mm from the first member and the second dowel pin 13 extends approximately 16 mm from the second member of the pliers device. All dimensions and measurements include a 10% plus or minus manufacturing tolerance.

Figure 6:
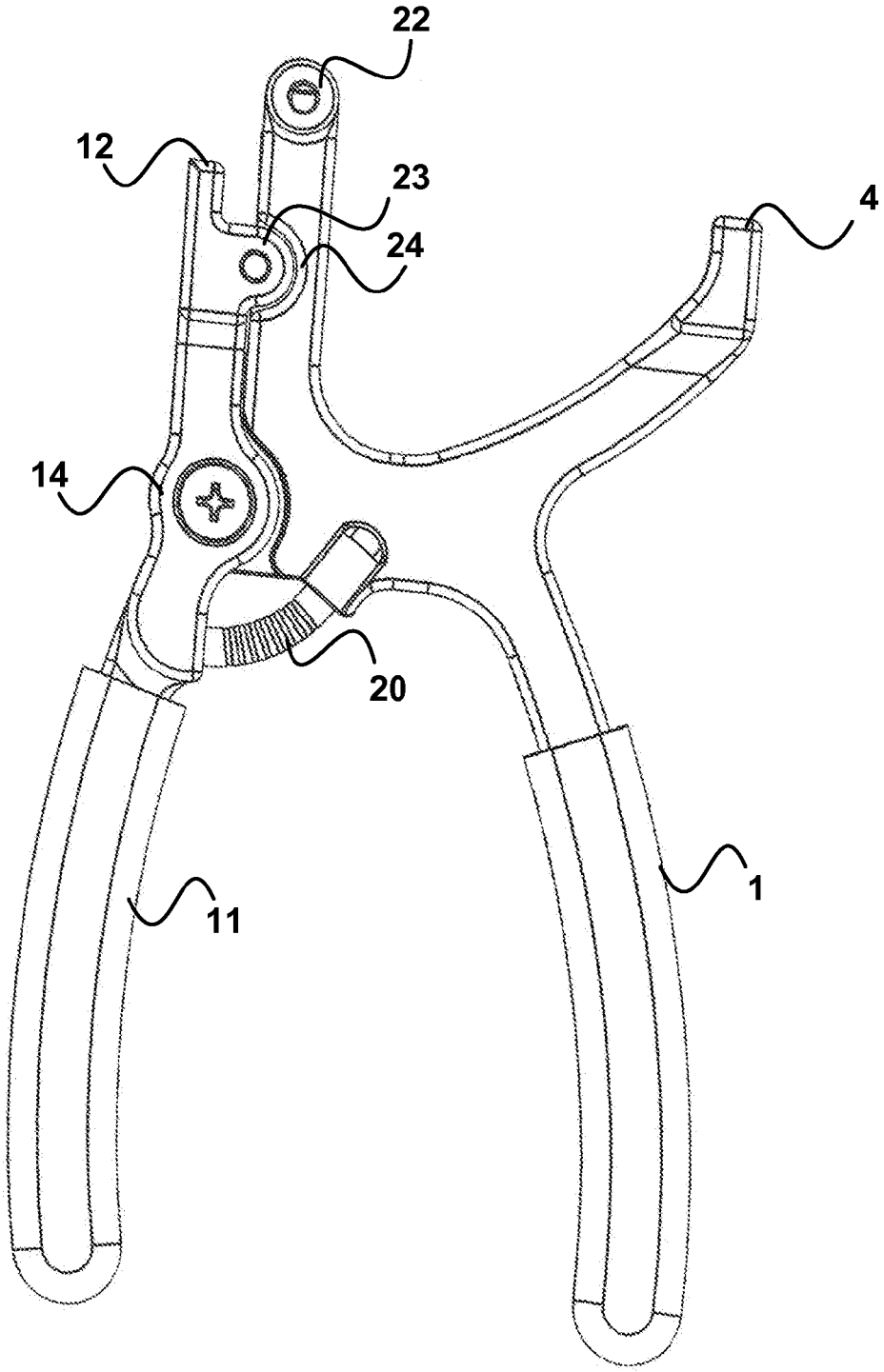
FIG. 6 depicts a closed right side perspective view of the first and second members of the string loop tensioning pliers device in accordance with an embodiment of the present disclosure.

FIG. 6 depicts a closed right side perspective view of the first and second members of the string loop tensioning pliers device in accordance with an embodiment of the present disclosure. From the right perspective the first lateral dowel pin boss 22 and the second lateral dowel pin boss 23 come into view. Also, from the right perspective the first member lateral dowel pin recess 24 is configured to receive the second dowel pin boss 23 may be seen. This perspective view depicts best the fixed arcuate jaw of the first member 1. Also, the spring 20 is depicted biased to position the first lateral dowel pin 5 into the middle prong rounded groove 7. Therefore, though the first and second members 1 and 11 are distally spaced apart, the spring 20 is in a compressed state. An inside distance from a tip of the arcuate claw end 4 of the lower jaw 3 of the first member to another tip of the notched end 12 of the second member measures approximately 52 mm in length plus or minus 10%.

Figure 7:
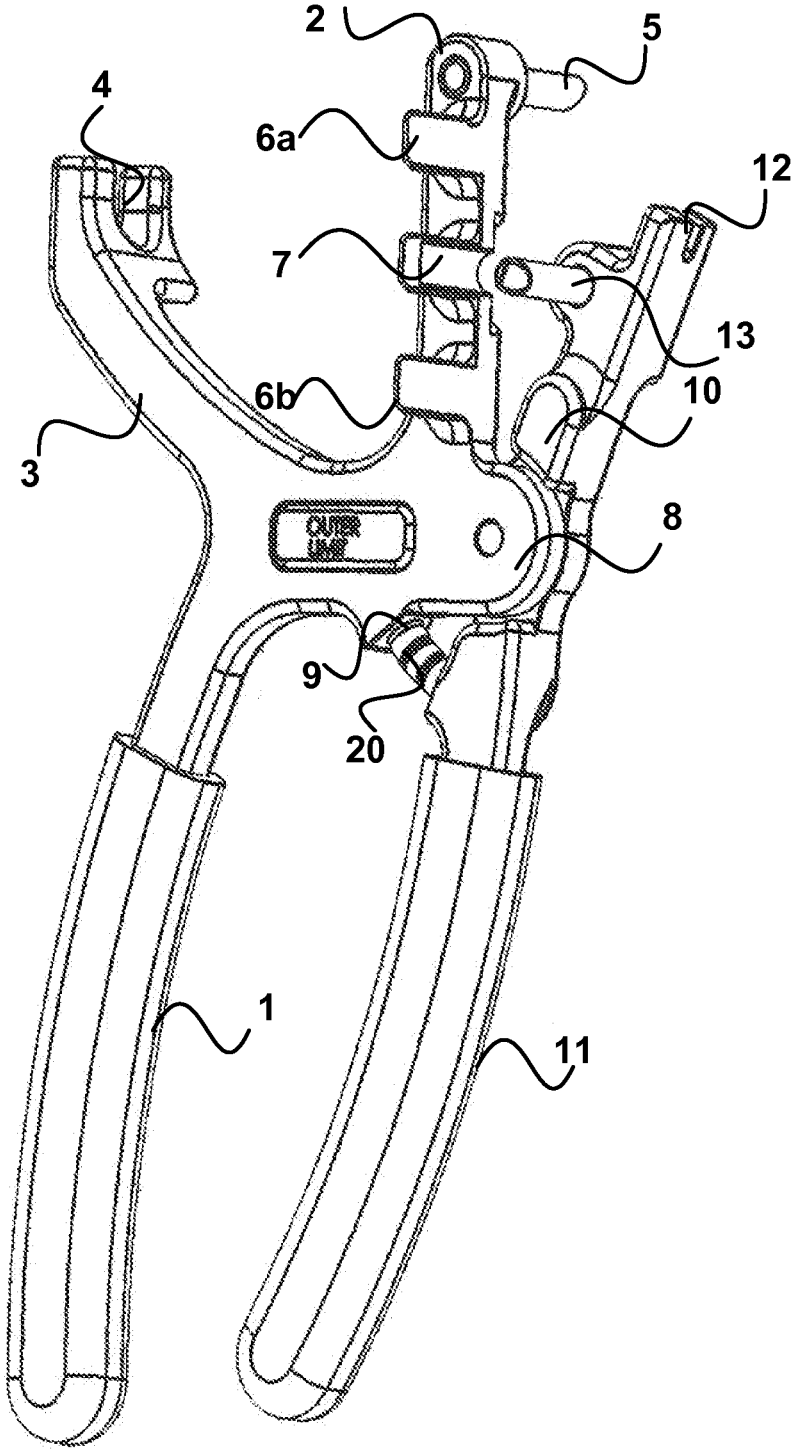
FIG. 7 depicts an open left side perspective view of the first and second members of the string loop tensioning pliers device in accordance with an embodiment of the present disclosure.

FIG. 7 depicts an open left side perspective view of the first and second members of the string loop tensioning pliers device in accordance with an embodiment of the present disclosure. The first member includes a first handle section 1, a fixed arcuate jaw comprising an upper jaw 2 and a lower jaw 3. The lower jaw has an arcuate claw end 4 and the upper jaw has a first lateral dowel pin end 5 and three in-line and lateral facing beveled prongs 6*a, b* and *c*. A middle prong 6*b* of the three has a rounded groove therein. The first member also includes a pivot boss 8 and a first spring bore 9. The second member pivotally connected to the first member includes a stop boss 10, a second handle section 11, a knot recess or notched end 12 opposite the handle section 11 and a second lateral dowel pin 13 configured to be partially recessed into the middle prong rounded groove 7 when the first handle 1 and the second handle 11 are distally positioned. The spring 20 is compressed further than in FIG. 5 to remove the first lateral dowel pin 5 from the middle prong rounded groove 7 for tensioning s string loop as will be explained in the method embodiments below.

Figure 8:
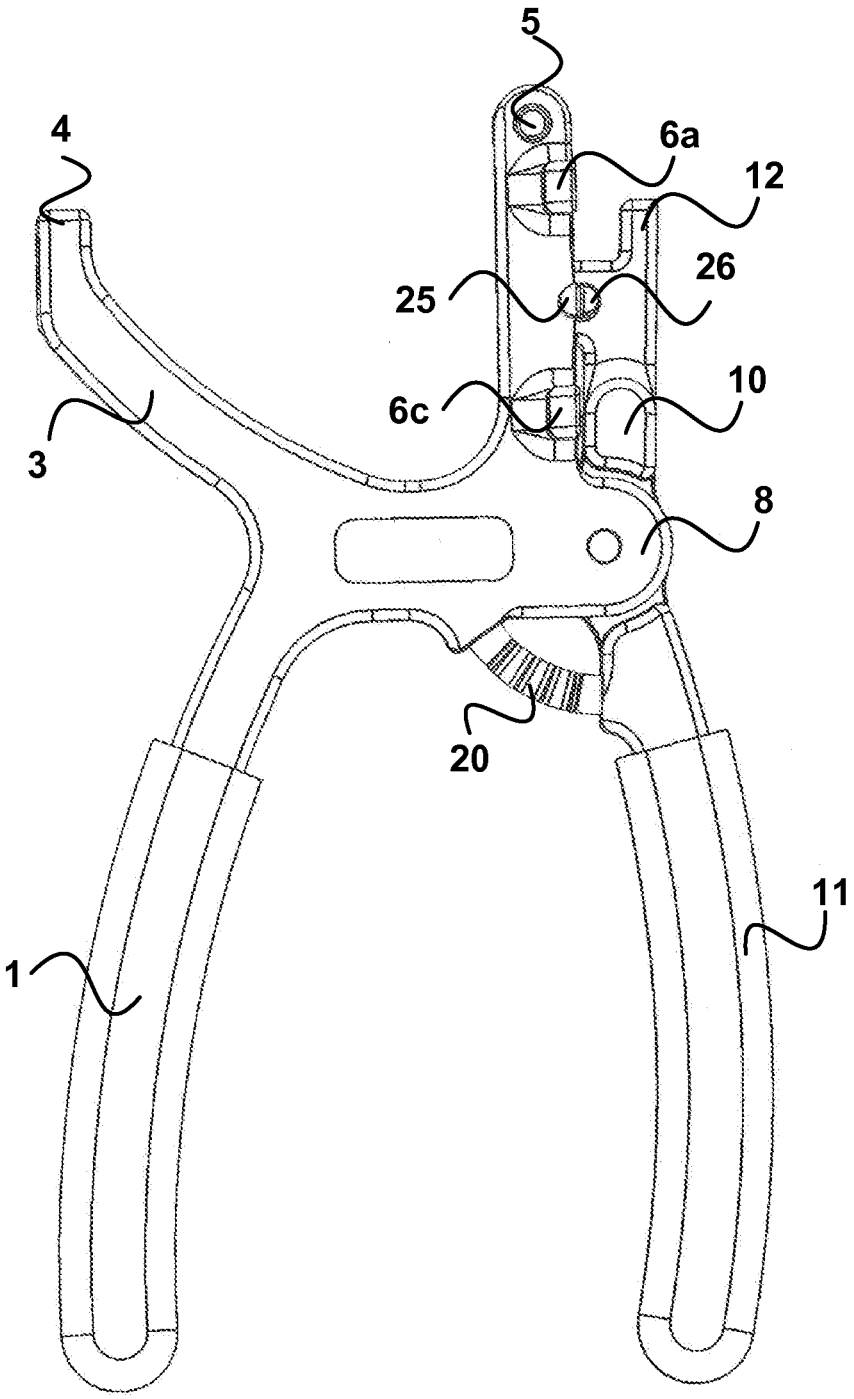
FIG. 8 depicts a side elevational view of an embodiment of the string loop tensioning pliers device comprising a semi-cylindrical middle prong joined with a semi-cylindrical second lateral prong.

FIG. 8 depicts a side elevational view of an embodiment of the string loop tensioning pliers device comprising a semi-cylindrical middle prong joined with a semi-cylindrical second lateral prong. The embodiment includes a first member handle 1, an upper jaw 2, a lower jaw 3, a lower jaw claw end 4, a first lateral dowel pin 5, a first prong 6*a*, a semi-cylindrical middle prong 25, a third prong 6*c*, a stop boss 10, a second member handle 11, a notched end 12 of the second member, a second semi-cylindrical prong 26, a spring 20 and other same or similar features as called out in other drawings disclosed herein. FIG. 8 illustrates the joining of the middle semi-cylindrical prong 25 and the second semi-cylindrical prong 26 to form a composite cylindrical member which may penetrate the string loop tensioned by the first lateral dowel. This embodiment is therefore able to form a smaller loop than is possible in a non-cylindrical middle prong configuration.

Figure 9:
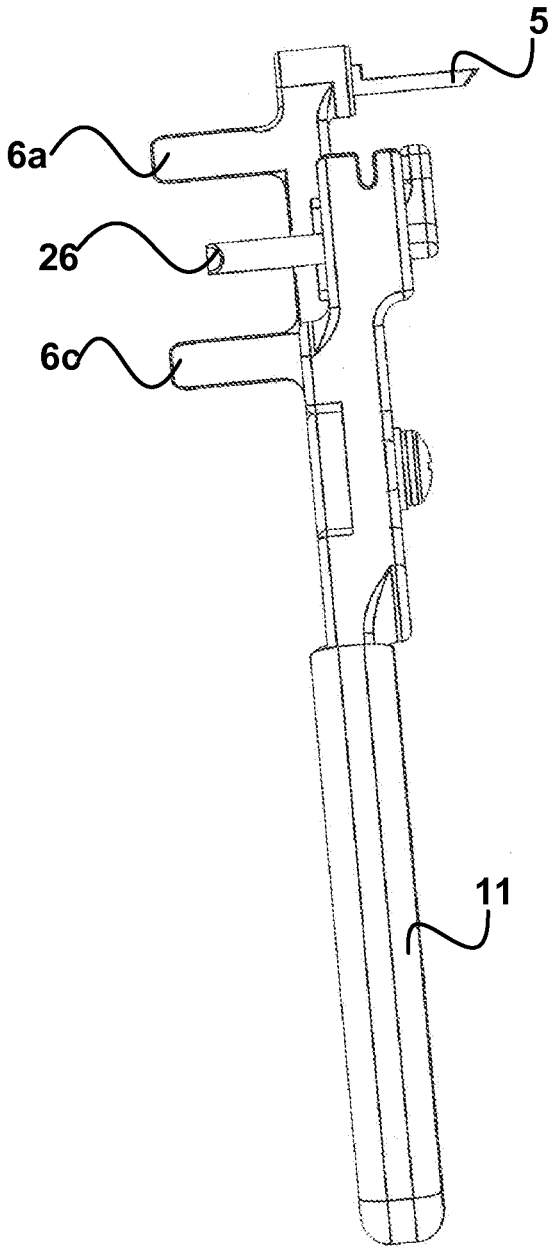
FIG. 9 depicts a top view of an embodiment of the string loop tensioning pliers device comprising a semi-cylindrical first lateral prong joined with a semi-cylindrical second lateral prong.

FIG. 9 depicts a top view of an embodiment of the string loop tensioning device comprising a semi-cylindrical first lateral prong joined to a semi-cylindrical second lateral prong. In the present embodiment of the disclosure, the middle prong (not shown) is configured as a semi-cylindrical lateral dowel pin comprising a flat side facing upward in relation to the lower and upper jaw. The second semi-cylindrical prong 26 is also comprises a complementary flat side facing the flat side of the middle prong 25. The first lateral dowel pin 5 is also configured as a semi-cylinder to enable inserting it into smaller string loops. The semi-cylindrical in-line and lateral facing beveled prongs each measure approximately 3 mm in diameter. The first semi-cylindrical prong 25 and extends laterally approximately 11-12 mm from the first member of the pliers device and the second semi-cylindrical prong extends laterally approximately 15 mm from the second member.

Figure 10:
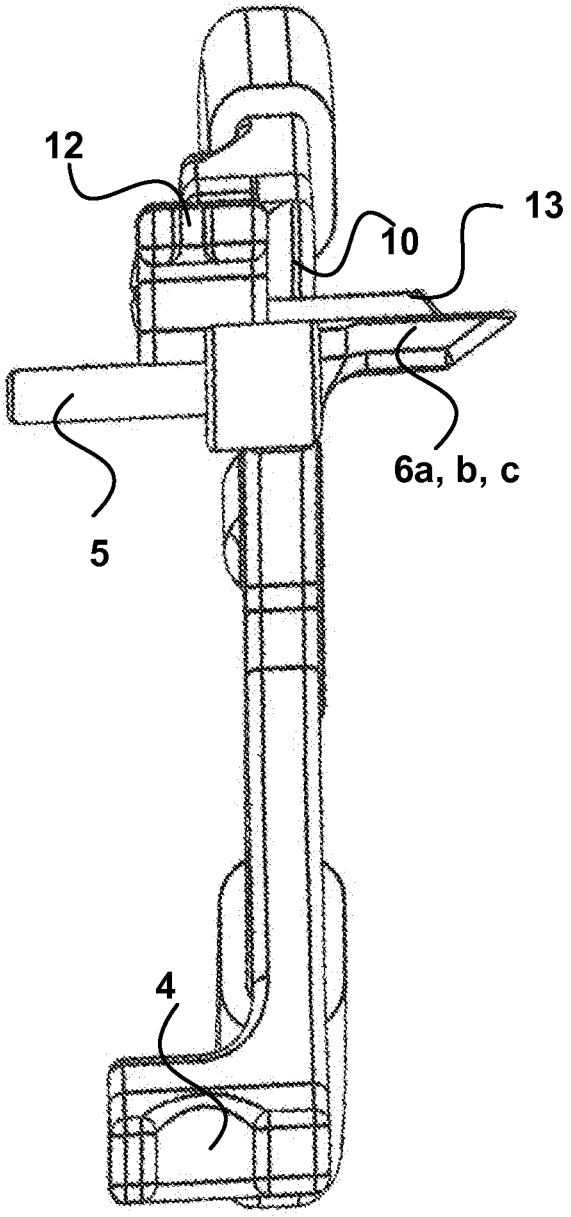
FIG. 10 depicts a closed front perspective view of the first and second members of the string loop tensioning pliers device in accordance with an embodiment of the present disclosure.

FIG. 10 depicts a closed front perspective view of the first and second members of the string loop tensioning pliers device in accordance with an embodiment of the present disclosure. The view shows the arcuate recess or concavity of the claw end 4, the knot recess or notched end 12, the stop boss 10 and the first lateral dowel pin 5 and the second lateral dowel pin 13 and the middle prong. The semi-cylindrical second lateral dowel pin 13 is joined to the semi-cylindrical middle prong. Profiles of the first and second members 1 and 11 intersect one another to allow access to a much smaller loop opening than possible in the prior art. Therefore, the semi-cylindrical second lateral dowel pin 13 joined with the semi-cylindrical middle prong may be inserted into a similar string loop diameter as that formed with the first lateral dowel pin 5. As discussed below in regards to FIG. 9, this novel and non-obvious feature of the present disclosure allows a user to create a smaller and tighter string loop than is possible in the prior art.

As can be seen in FIG. 10, the bevel of the second lateral dowel pin 13 and the bevel of the middle prong 6*b* both slope away from a middle axial point of the second dowel pin 13 joined to the middle prong 6*b* when the first and second members are distally positioned at a maximal distance from each other. This effective double bevel facilitates the insertion of the pliers device into a tied or formed string loop for tensioning or tightening the string loop and the string loop knots on the bowstring.

Figure 11:
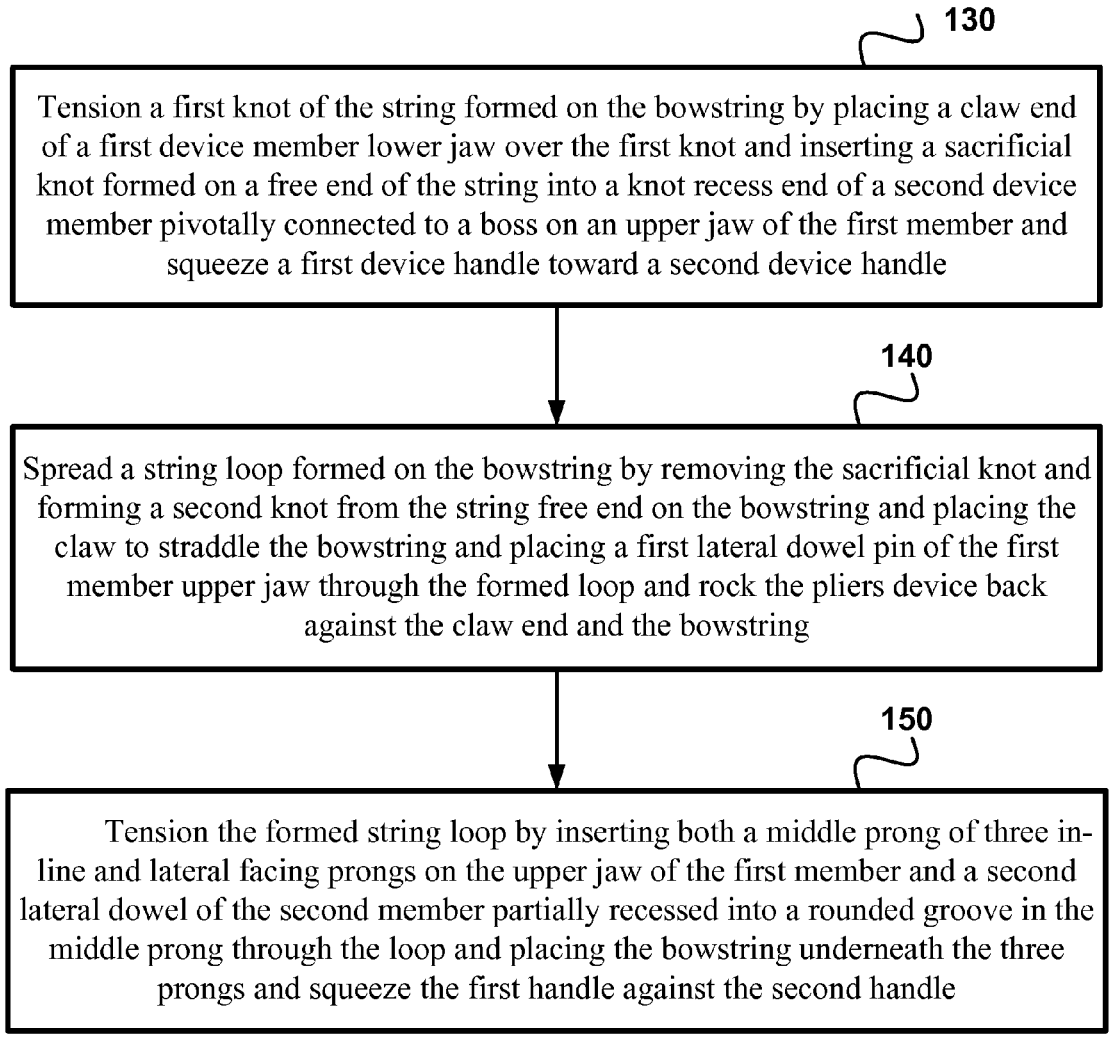
FIG. 11 depicts a flow chart of steps in a method for using the string loop tensioning pliers device on a bowstring in accordance with an embodiment of the present disclosure.

FIG. 11 depicts a flow chart of steps in a method for using the string loop tensioning pliers device on a bowstring in accordance with an embodiment of the present disclosure. The method includes providing a first member having a first handle section and a fixed arcuate jaw comprising an upper jaw and a lower jaw. The lower jaw has an arcuate claw end and the upper jaw has a pivot boss, a first lateral dowel pin end and three in-line and lateral facing beveled prongs. A middle prong of the three is configured to join with the second lateral dowel pin. The method also includes providing a second member pivotally connected to the first member and having a second handle section, a notched end opposite the handle section and a pivot boss there between and a second lateral dowel pin configured to be join with the middle prong when the first handle and the second handle are distally positioned.

An embodiment of a method of using the string loop tensioning pliers device on a bowstring additionally includes 130 tensioning a first knot of the string formed on the bowstring by placing a claw end of a first device member lower jaw over the first knot and inserting a sacrificial knot formed on a free end of the string into a knot recess or notched end of a second device member pivotally connected to a boss on an upper jaw of the first member and squeezing a first device handle toward a second device handle. The method further includes 140 spreading a string loop formed on the bowstring by removing the sacrificial knot and forming a second knot from the string free end on the bowstring and placing the claw to straddle the bowstring and placing a first lateral dowel pin of the first member upper jaw through the formed loop and rocking the pliers device back against the claw end and the bowstring. This step 140 pre-tensions the string loop in preparation for further tensioning. The method yet includes 150 further tensioning the formed string loop by inserting a middle prong of three in-line and lateral facing prongs on the upper jaw of the first member joined with a second lateral dowel of the second member through the loop and placing the bowstring underneath the three prongs and squeezing the first handle against the second handle.

Figure 12A:
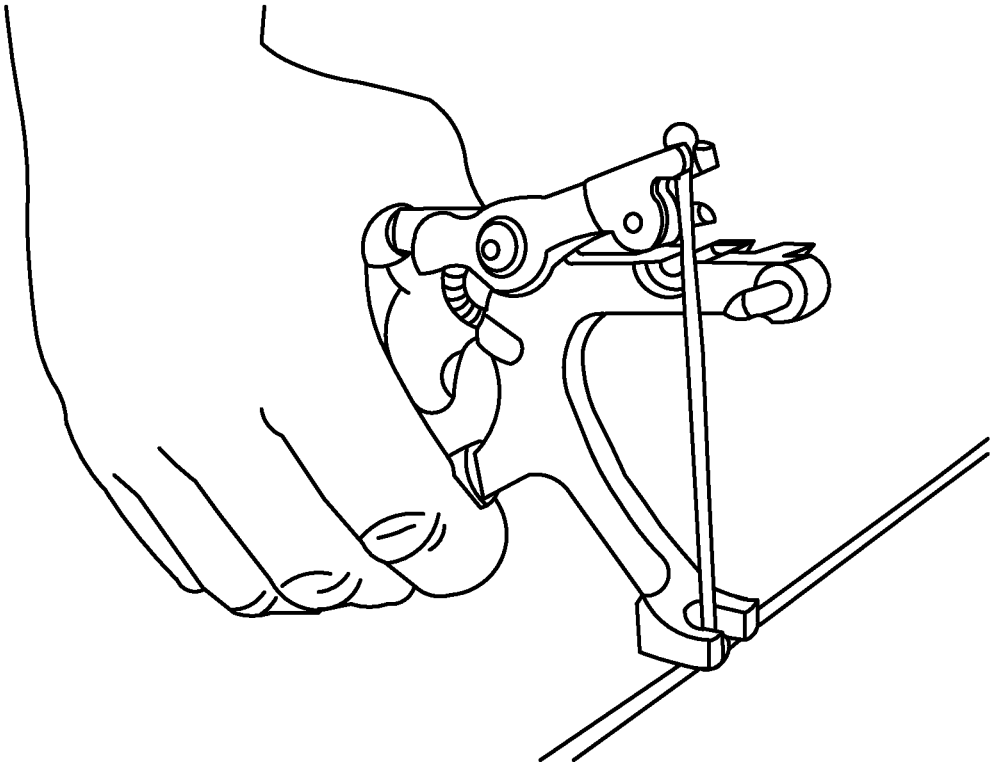
FIG. 12*a* is an illustration depicting a step for tensioning a first knot of a string onto a bowstring using the pliers device in accordance with an embodiment of a method of the present disclosure.

FIG. 12*a* is an illustration depicting a step for tensioning a first knot of a string onto a bowstring using the pliers device in accordance with an embodiment of a method of the present disclosure. The user may cut a piece of string loop material to approximately five and ½ inches, burn both ends to seal the string fibers against unraveling and tie a sacrificial square knot in one end. The sacrificial knot is used to tension the string with the pliers device and is later removed when completing the string loop on the bowstring. The user may position the arrow on the bowstring and move the first cow hitch knot to where the arrow is perpendicular to the bowstring. The user may apply step 130 as discussed above to tension the first cow hitch knot and the string.

As can be seen in FIG. 12*a*, the arcuate recess of the claw end of the lower jaw of the first member and the knot recess or notch of the second member are both configured in a straight line relative to each other and substantially perpendicular to a plane comprising the three in-line and lateral facing beveled prongs.

Figure 12B:
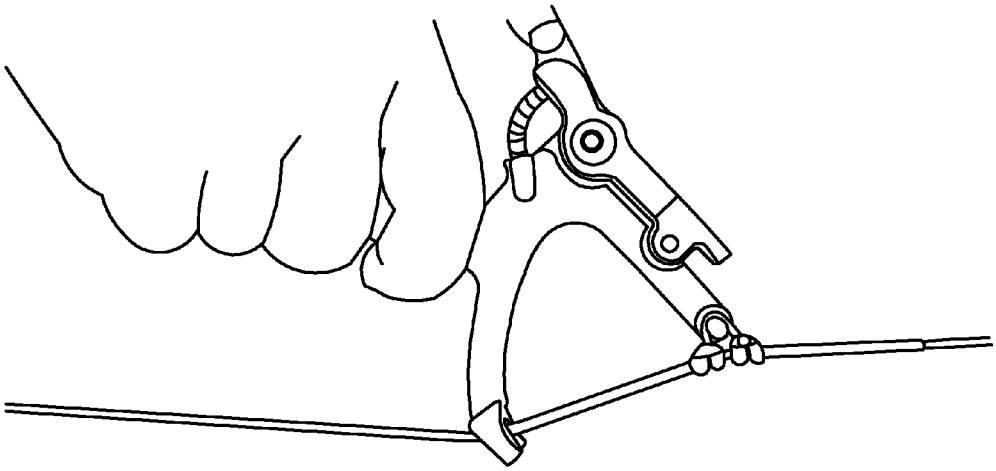
FIG. 12*b* is an illustration depicting a step for spreading a string loop formed on a bowstring using the pliers device in accordance with an embodiment of a method of the present disclosure.

FIG. 12*b* is an illustration depicting a step for spreading a string loop formed on a bowstring using the pliers device in accordance with an embodiment of a method of the present disclosure. A user of the pliers device may apply step 140 as discussed above in spreading the string loop. The user may cut the sacrificial square knot from the tensioned string, burn the newly cut end and tie the second cow hitch knot onto the bowstring. The user may insert the first lateral dowel into the string loop and rock the first member jaw backwards against the arcuate claw end against the bowstring creating an upward pull on the string loop. The rocking motion therefore puts a pre-tension on the string loop prior to further tensioning the string loop as discussed below. A distance between a tip of the claw end to a center of the first lateral dowel pin of the upper jaw measures approximately 65 to 70 mm to create a moment arm of at least the same length when the first lateral dowel pin is inserted into a string loop and the pliers device is rocked back against the claw end on a bowstring.

Figure 12C:
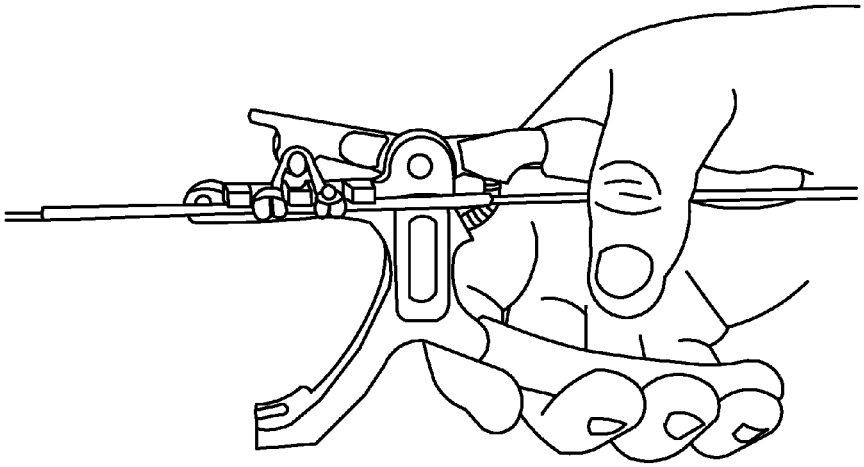
FIG. 12*c* is an illustration depicting a step for tensioning the formed string loop using the pliers device in accordance with an embodiment of a method of the present disclosure.

FIG. 12*c* is an illustration depicting a step for fully tensioning the formed string loop using the pliers device in accordance with an embodiment of a method of the present disclosure. A user of the pliers device may apply step 150 as discussed above in fully tensioning the strip loop. The user inserts the second dowel end recessed into the rounded groove and the middle prong into the string loop with the bowstring placed beneath the three prongs and parallel to the handles of the pliers device. The bowstring is therefore supported in between and on both sides of the first and second knots of the string loop providing a semi-rigid configuration for tensioning the string loop orthogonally to the bowstring. The user squeezes the first and second handles together to disjoin the second lateral dowel from the third prong and thereby lift the string loop to create a maximum tension in the string loop. The mechanical advantage of the pliers' long handles relative to the moment arm across the pivot pin to the lateral dowel is thus transferred to a maximum tension in the strip loop. This maximum tension applied to the strip loop using the pliers device is thus greater than the tension applied to the string loop in archery use on the bowstring on a strung bow.

Figure 13:
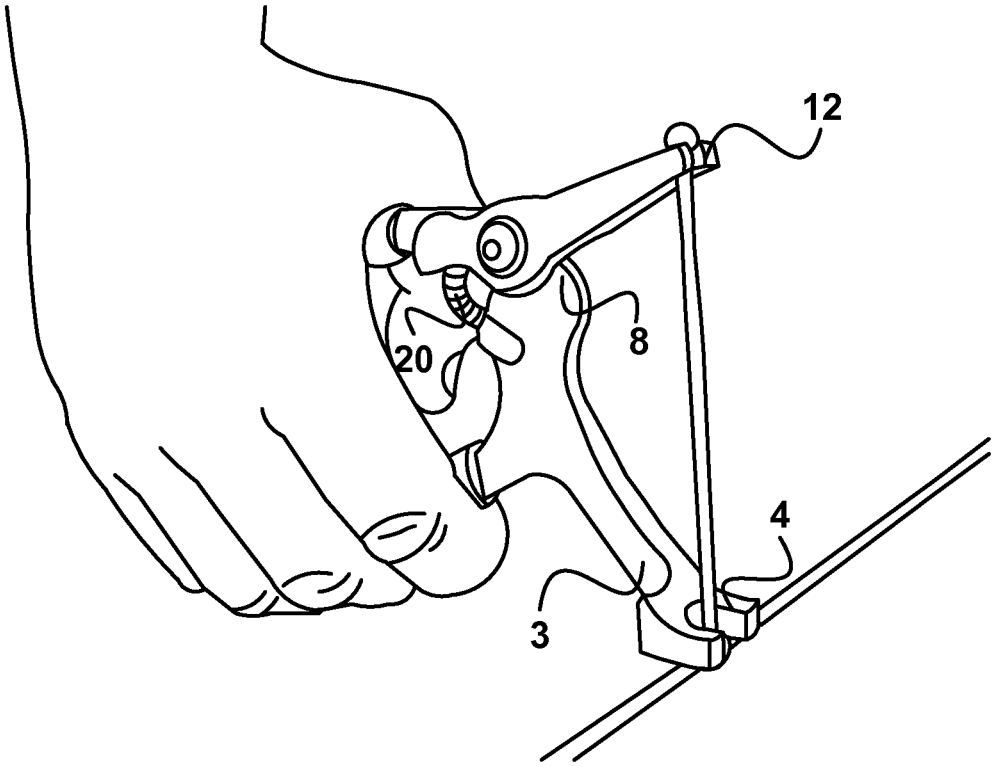
FIG. 13 depicts a perspective view of a tensioning pliers device in accordance with an embodiment of the present disclosure.

FIG. 13 depicts a perspective view of a tensioning pliers device in accordance with an embodiment of the present disclosure. The tensioning pliers device depicted includes a first member having a first handle end held by a user, an arcuate claw end 4 opposite the handle end and a pivot boss 8 extending distally from the handle end and claw end 4. The tensioning pliers also include a second member pivotally connected to the first member at the pivot boss 8, the second member comprising a second handle end and a notched end 12 opposite the handle end, the notched end configured to be distally positioned to the claw end 4 when the handles are proximally positioned by a user squeezing the handles together. Therefore, the tensioning pliers is a simplified embodiment of the string loop tensioning pliers and may be used to perform step 130 to tension a first knot of the string formed on the bowstring.

Figure 14:
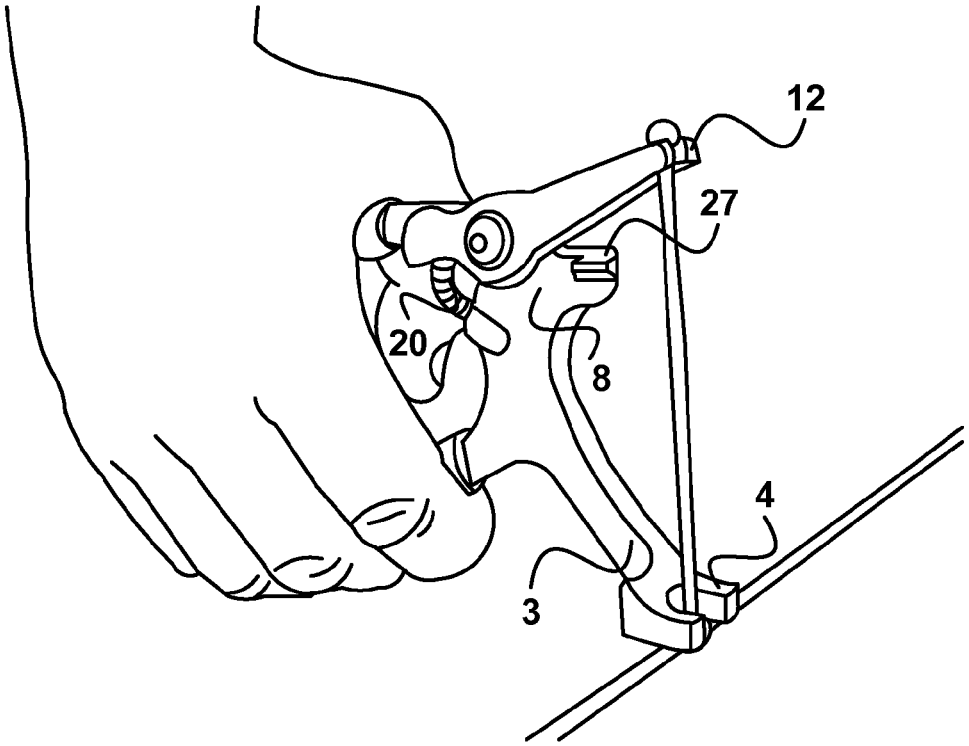
FIG. 14 depicts a perspective view of a tensioning pliers device with a stop boss in accordance with an embodiment of the present disclosure.

FIG. 14 depicts a perspective view of a tensioning pliers device with a stop boss in accordance with an embodiment of the present disclosure. The stop boss 27 is formed on the first member near the pivot boss 8 and serves to limit a distal extension of the first handle from the second handle so that a user may easily grasp the tensioning pliers in his or her hand. A stop boss 10 formed on the second member (not depicted) near a pivot point of the first and second members serves in a similar manner to the stop boss 27.

Smaller and tighter string loops are thus possible using the disclosed tensioning pliers device and method for multiple reasons. The mechanical advantage in rocking the pliers in step 140 and tensioning the string loop in step 150 allows a much tighter string loop than possible in the prior art. Also, the disclosed device and method of use pulls all the available creep out of the knot and string fiber when creating the string loop rather than in using the string loop. Furthermore, the combined but reduced profile of the second lateral dowel pin 13 recessed into the rounded groove of the middle prong 7 allows for much smaller initial loops to be tied on the bowstring. Therefore, the disclosed string loop tensioning pliers device and method provide a novel and non-obvious device and method for producing smaller and tighter string loops on bowstrings.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

Notwithstanding specific embodiments of the invention have been described and illustrated, the invention is not to be limited to the specific forms or arrangements of parts so described and illustrated. The scope of the invention is to be defined by the claims and their equivalents to be included by reference in a non-provisional utility application.

What is claimed is:

1. A string loop tensioning pliers device, comprising:

a first member having a first handle section, a pivot and three lateral facing prongs extending sideways from the first handle section, a middle prong thereof configured to receive a second member lateral facing prong;

a second member comprising a second handle section, a pivot and the second member lateral facing prong extending sideways from the second handle section, the second member pivotally connected to the first member pivot at the second member pivot; and a fixed arcuate jaw section comprising an upper jaw and a lower jaw, the lower jaw having an arcuate claw end and the upper jaw comprising the pivot and the three lateral facing prongs.

2. A string loop tensioning pliers device, comprising:

a first member having a first handle section, a pivot and three lateral facing prongs extending sideways from the first handle section, a middle prong thereof configured to receive a second member lateral facing prong;

a second member comprising a second handle section, a pivot and the second member lateral facing prong extending sideways from the second handle section, the second member pivotally connected to the first member pivot at the second member pivot;

a fixed arcuate jaw section comprising an upper jaw and a lower jaw, the lower jaw having an arcuate claw end and the upper jaw comprising the pivot and the three lateral facing prongs;

a first lateral dowel pin at an end of the upper jaw and a notched end opposite the handle section, the pivot between the notched end and the handle section, and the second member prong configured to join with the middle prong of the first member when the first handle and the second handle are distally positioned; and a rounded groove in the middle prong configured to receive a rounded portion of the second lateral dowel pin along a length of the second member prong when the first handle and the second handle are distally positioned; and wherein the first dowel pin extends in an opposite lateral direction to the three in-line and lateral facing beveled prongs and the second member prong is a second dowel pin that extends in the same lateral direction as the three beveled prongs, the first and second dowel pins both secured at one end to a respective member and an unsecured end is beveled to facilitate the penetration of the respective dowel pin into a small loop of string.

3. A string loop tensioning pliers device, comprising:

a first member having a first handle end, a fixed arcuate jaw opposite the handle end and a pivot boss extending distally from the handle and the arcuate jaw, the arcuate jaw comprising an upper jaw and a lower jaw, the lower jaw comprising an arcuate claw end, the upper jaw comprising a first lateral dowel pin end and three in-line and lateral facing beveled prongs, a middle prong thereof configured to join with a second lateral dowel pin; and a second member pivotally connected to the first member at the pivot boss, the second member comprising a second handle end, the second lateral dowel pin, and a notched end opposite the handle end, the notched end configured to be distally positioned to the claw end when the handles are proximally positioned and the second lateral dowel pin configured to join with the middle prong of the first member when the first handle and the second handle are distally positioned.

4. The string loop tensioning pliers device of claim 3, wherein an inside distance from a tip of the claw end to a tip of the notched end measures approximately 70 mm when the first and second handles are distally positioned.

5. The string loop tensioning pliers device of claim 3, further comprising a stop boss extending from one of the first member and the second member, the stop boss configured to limit a distal position of the first handle relative to the second handle.

6. The string loop tensioning pliers device of claim 3, further comprising a spring disposed between the first handle and the second handle, the spring configured to position the first handle distally from the second handle, the spring also configured to oppose the first handle moving toward the second handle.

7. The string loop tensioning pliers device of claim 3, wherein the first and second dowel pins measure approximately 3 mm in diameter and the first dowel pin extends approximately 18 mm from the first member and the second dowel pin extends approximately 16 mm from the second member of the pliers device.

8. The string loop tensioning pliers device of claim 3, wherein the three in-line and lateral facing beveled prongs are spaced apart approximately 8 to 10 mm to accommodate a string knot on either side of the middle prong and each prong adjacent to the middle prong extends approximately 17 mm from the upper jaw and is approximately 6 mm wide by approximately 3 mm thick and a bottom side of each adjacent prong facing the lower jaw is substantially flat.

9. The string loop tensioning pliers device of claim 3, wherein an inside distance between a first tip of the claw end to a second tip of the claw end measures approximately 8 to 10 mm and an inside diameter between the claw tips measures 8 to 10 mm to accommodate a knot tied in a string loop to a bow string.

10. The string loop tensioning pliers device of claim 3, wherein a distance between a tip of the claw end to a center of the first lateral dowel pin of the upper jaw measures approximately 65 to 70 mm to create a moment arm of at least the same length when the first lateral dowel pin is inserted into a string loop and the pliers device is rocked back against the claw end on a bowstring.

11. The string loop tensioning pliers device of claim 3, wherein a recess of the notched end of the second member measures approximately 4 mm in length by 2 mm wide to accommodate a typical string loop thickness.

* * * * *